US009089177B2

(12) United States Patent
Best et al.

(10) Patent No.: US 9,089,177 B2
(45) Date of Patent: Jul. 28, 2015

(54) WRIST GUARD WITH STIFFENER ELEMENTS

(75) Inventors: Bill Best, Orono, MN (US); Bastien Jourde, Montreal (CA)

(73) Assignee: Shock Doctor, Inc., Plymouth, MN (US)

( * ) Notice: Subject to any disclaimer, the term of this patent is extended or adjusted under 35 U.S.C. 154(b) by 1099 days.

(21) Appl. No.: 13/015,145

(22) Filed: Jan. 27, 2011

(65) Prior Publication Data

US 2011/0283432 A1 Nov. 24, 2011

Related U.S. Application Data

(60) Provisional application No. 61/300,095, filed on Feb. 1, 2010.

(51) Int. Cl.
*A41D 19/00* (2006.01)
*A41D 13/08* (2006.01)

(52) U.S. Cl.
CPC ..... *A41D 13/088* (2013.01); *A41D 13/081* (2013.01)

(58) Field of Classification Search
CPC ..... A41D 19/01582; A41D 19/01588; A41D 19/01523; A41D 13/081; A41D 13/088; A63B 71/141; A63B 71/145; A63B 71/146; A63B 71/14; A63B 71/1225; A63B 71/08; A63B 71/081; A63B 69/0046; A63B 2071/125; A61F 5/01; A61F 5/0118
USPC ..... 2/16, 20, 159, 161.1, 161.2, 161.6, 162, 2/917; 602/20, 21, 60–64; 128/878, 879
See application file for complete search history.

(56) References Cited

U.S. PATENT DOCUMENTS

| | | | | |
|---|---|---|---|---|
| 2,154,197 | A * | 4/1939 | Callaway | 2/159 |
| 3,728,738 | A * | 4/1973 | Andolino | 2/161.1 |
| 3,970,305 | A | 7/1976 | Hawkins | |
| 4,183,098 | A | 1/1980 | Knowles | |
| 4,330,120 | A * | 5/1982 | Netti | 482/105 |
| 4,854,310 | A | 8/1989 | Lee | |
| 5,339,465 | A | 8/1994 | Kyewski | |
| D360,059 | S | 7/1995 | Kalvestran et al. | |
| 5,453,064 | A * | 9/1995 | Williams, Jr. | 482/47 |
| 5,600,849 | A | 2/1997 | Hu | |
| D392,072 | S | 3/1998 | Levine | |
| 5,728,059 | A * | 3/1998 | Wiesemann et al. | 602/64 |
| 5,733,249 | A | 3/1998 | Katzin et al. | |

(Continued)

FOREIGN PATENT DOCUMENTS

| | | |
|---|---|---|
| EP | 0648437 A1 | 4/1995 |
| EP | 0658322 B1 | 6/1995 |
| WO | 9724085 A1 | 7/1997 |

OTHER PUBLICATIONS

International Search Report and Written Opinion issued in PCT/US2001/022731, mailed Jul. 21, 2011, 11 pages.

*Primary Examiner* — Alissa L Hoey
*Assistant Examiner* — Jameson Collier
(74) *Attorney, Agent, or Firm* — Faegre Baker Daniels LLP

(57) ABSTRACT

Wrist guards configured for providing support to a user's wrist are disclosed. An illustrative wrist guard includes a wrist pad having a dorsal section configured for placement adjacent to the anterior side of the user's wrist and a palmar section configured for placement adjacent to the posterior side of the wrist. A number of stiffener elements coupled to the dorsal section of the wrist pad provide support against hyperextension of the user's wrist.

13 Claims, 12 Drawing Sheets

(56) References Cited

U.S. PATENT DOCUMENTS

| | | | | |
|---|---|---|---|---|
| 5,810,753 | A | 9/1998 | Eberbach | |
| 5,813,050 | A | 9/1998 | Popowski | |
| D400,310 | S | 10/1998 | Chang | |
| 5,873,130 | A * | 2/1999 | Lafferty | 2/16 |
| 5,933,868 | A | 8/1999 | Bender | |
| D418,257 | S | 12/1999 | Holland | |
| 6,024,715 | A * | 2/2000 | Maxwell | 602/64 |
| D434,533 | S | 11/2000 | Hsieh | |
| 6,186,969 | B1 * | 2/2001 | Bell et al. | 602/64 |
| 6,213,969 | B1 * | 4/2001 | MacMorran et al. | 602/64 |
| 6,219,843 | B1 | 4/2001 | Passi et al. | |
| 6,526,592 | B1 | 3/2003 | Best | |
| 6,785,909 | B1 | 9/2004 | Li | |
| 7,033,331 | B1 * | 4/2006 | Hely | 602/21 |
| 7,645,250 | B2 * | 1/2010 | Koby et al. | 602/21 |
| D656,685 | S | 3/2012 | Best et al. | |
| D692,619 | S | 10/2013 | Best et al. | |
| 2002/0193719 | A1 * | 12/2002 | Yewer, Jr. | 602/21 |
| 2004/0049141 | A1 * | 3/2004 | Slautterback et al. | 602/21 |
| 2004/0106889 | A1 * | 6/2004 | Robinson | 602/64 |
| 2005/0267391 | A1 * | 12/2005 | Garelick et al. | 602/21 |
| 2007/0022512 | A1 | 2/2007 | Coulter et al. | |
| 2007/0157364 | A1 | 7/2007 | Comstock et al. | |
| 2009/0082708 | A1 * | 3/2009 | Scott et al. | 602/21 |

* cited by examiner

WRIST GUARD WITH STIFFENER ELEMENTS

CROSS-REFERENCE TO RELATED APPLICATION

This application claims the benefit of Provisional Application No. 61/300,095, filed Feb. 1, 2010, which is incorporated herein by reference in its entirety for all purposes.

TECHNICAL FIELD

The present invention relates generally to protective devices. More specifically, the present invention pertains to wrist guards configured for providing support to a user's wrist.

BACKGROUND

Protective devices such as wrist guards, knee and leg guards, and helmets are frequently utilized in a variety of recreational and sports activities for providing protective support to a user's limbs and head. In activities such as motocross, skateboarding, and snowboarding, for example, wrist guards are sometimes worn to protect against hyperextension or hyperflexion of the user's wrist in the event of an accident or collision. Wrist guards are also used in other contexts such as in orthopedic devices to maintain strength and stability in individuals suffering from a wrist fracture or dislocation, or for individuals that are prone to repetitive stress injuries involving the wrist or hands. In some cases, for example, wrist braces are worn by individual's that suffer from repetitive stress disorders such as Carpal Tunnel Syndrome.

Although wrist guards are often effective in providing the user with additional wrist support, many sports and recreational activities demand that the user have full flexibility and dexterity of the wrist and hands to maneuver sufficiently. In motocross riding, for example, flexibility and control over the rider's wrist and hands is often necessary to maintain rider balance and to adequately grip and manipulate the handlebars of the motorcycle.

BRIEF SUMMARY

The present invention relates generally to wrist guards configured for providing support to a user's wrist. A wrist guard in accordance with an illustrative embodiment includes a wrist pad attachable to a user's wrist, a number of stiffener elements coupled to the wrist pad for providing additional stiffness, and a number of fasteners for securing the wrist guard to the user's wrist and hand. The wrist pad includes a dorsal section configured for placement adjacent to the posterior side of the user's wrist and palmar section configured for placement adjacent to the anterior side of the user's wrist. The stiffener elements can each comprise an elongate stay having a thickness that varies along its length, either continuously or at one or more discrete locations. A number of cushioning members coupled to the palmar section of the wrist pad can also be used to provide additional cushioning to the user's wrist and hand.

Figure 1:
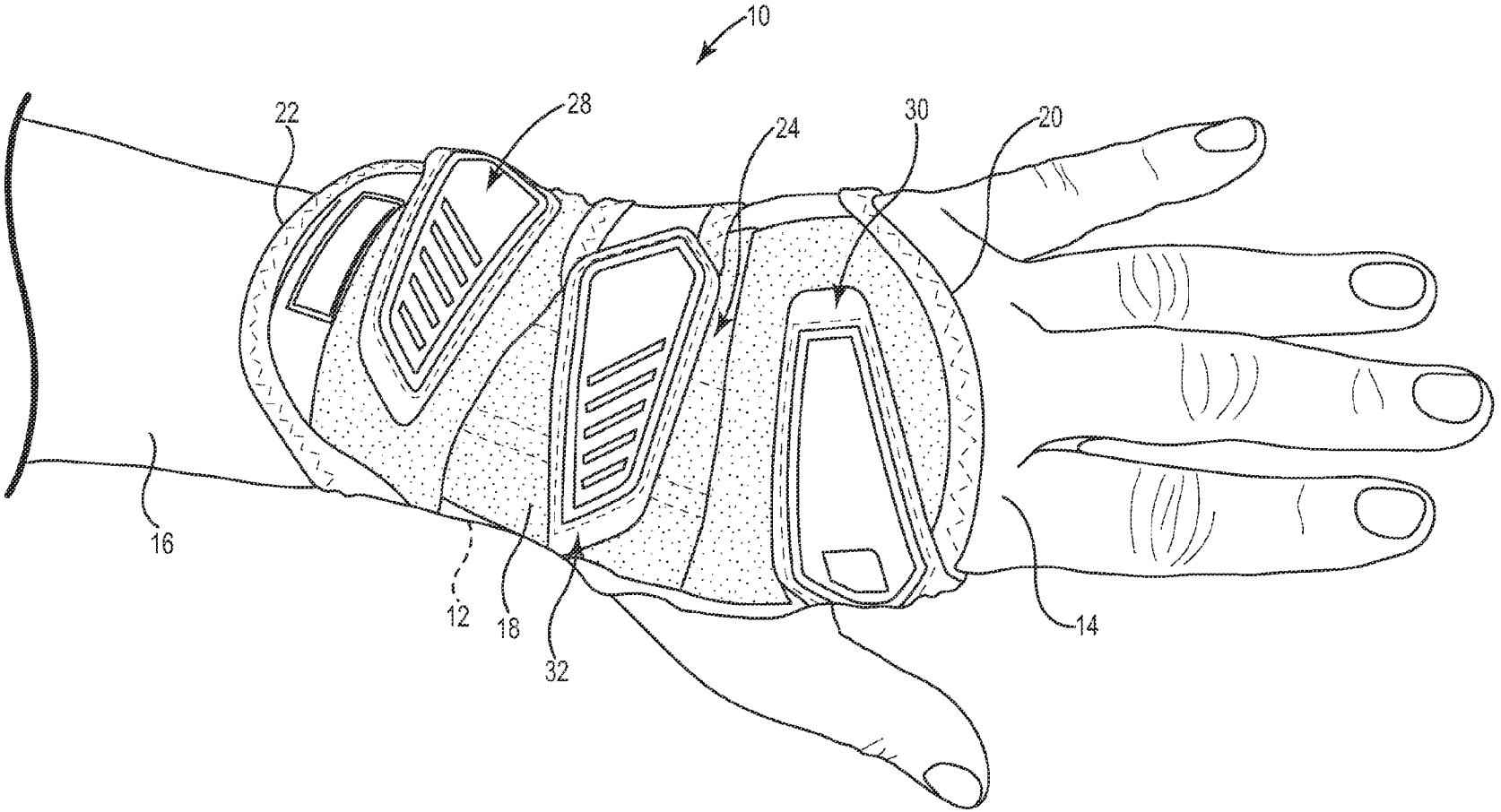
FIG. 1 is a perspective view showing a wrist guard in accordance with an illustrative embodiment attached to a user's wrist.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 2:
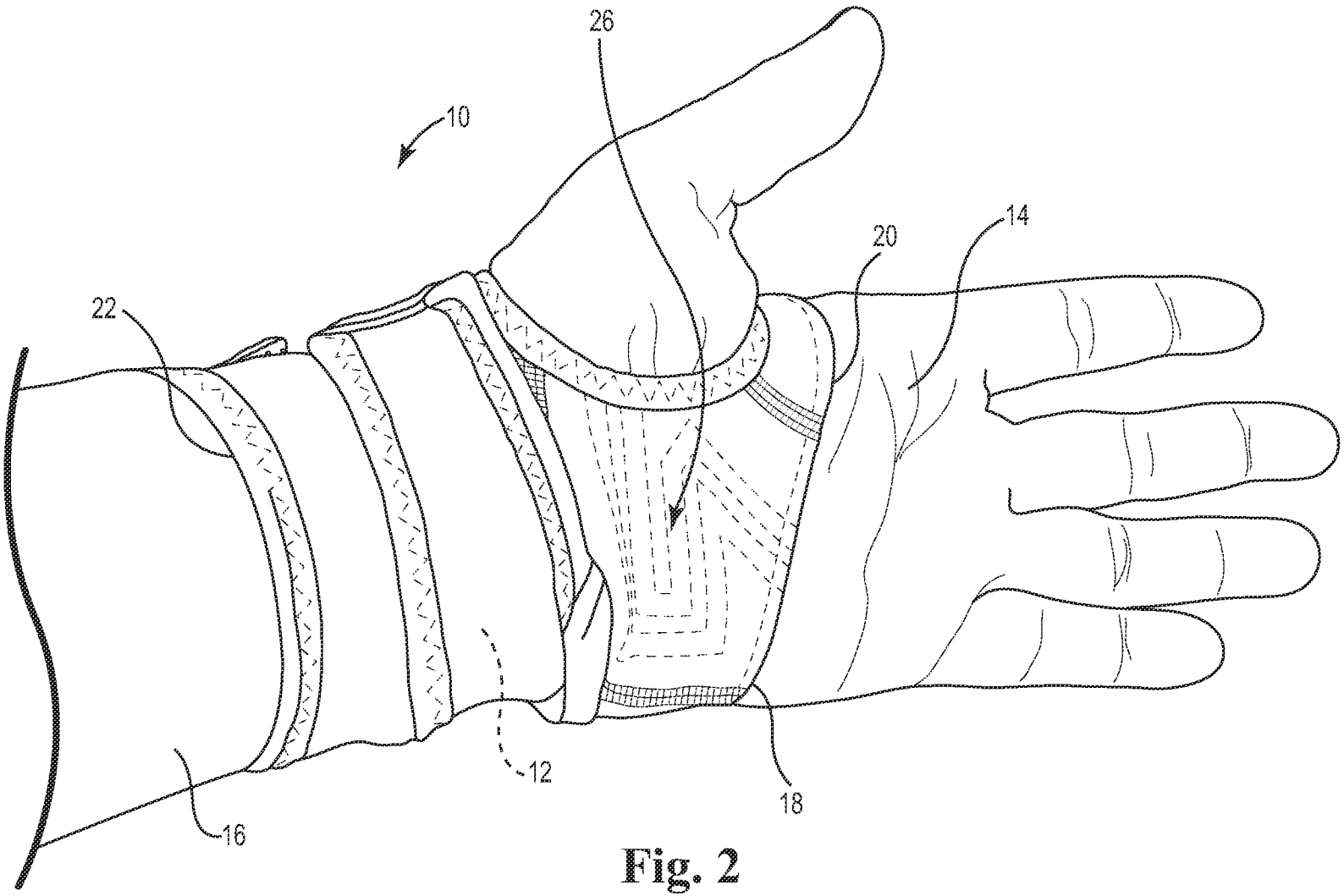
FIG. 2 is a perspective view showing the attachment of the wrist guard of FIG. 1 to the anterior side of the user's wrist.

FIGS. 1 and 2 are several perspective views showing a wrist guard 10 in accordance with an illustrative embodiment attached to a user's wrist 12. The wrist guard 10 can be configured for use about either the user's left or right wrist, and can be configured to accommodate a variety of wrist sizes. The wrist guard 10, illustratively shown as a left-handed wrist guard, includes a generally rectangular-shaped wrist pad 18 having a distal edge 20 that extends over at least a portion of the user's hand 14 and terminating at or near the metacarpus of the fingers, and a proximal edge 22 located opposite the distal edge 20 that extends over at least a distal portion of the user's forearm 16 proximal to the wrist 12.

As best shown in FIG. 1, a dorsal section 24 of the wrist guard 10 is configured to lay adjacent to the posterior side of the user's wrist 12. As further shown in FIG. 2, a palmar section 26 of the wrist guard 10 located opposite the dorsal section 24 is configured to lay adjacent to the anterior, palmar side of the user's wrist 12. Together, the dorsal and palmar sections 24, 26 of the wrist guard 10 help to maintain the user's wrist 12 in a neutral position in order to prevent wrist hyperextension or hyperflexion. As discussed in greater detail herein, a number of stiffener elements located adjacent to the dorsal section 24 and extending lengthwise along the general length of the wrist guard 10 between the proximal and distal edges 20, 22 are configured to provide additional stiffening support to the wrist 12, and in particular, protection against hyperextension of the wrist 12.

A number of elastic retaining members 28, 30, 32 on the wrist guard 10 can be used to adjustably secure the wrist guard 10 to the user's wrist 12 in a variety of different positions. In some embodiments, the construction of the retaining members 28, 30, 32 allows the wrist guard 10 to be secured to the user's wrist 12 by wrapping the wrist pad 18 about the wrist 12 and a lower portion of the hand 14, and then securing the retaining members 28, 30, 32 from a position on one side of the hand 14 to the other.

The wrist pad 18 can be fabricated from a suitable material that provides support to the user's wrist 12 while also providing flexibility to portions of the hand 14 and forearm 16. Examples of suitable materials for the wrist pad 18 can include, but are not limited to, nylon, spandex (e.g., LYCRA), and rubber (e.g., NEOPRENE). Markings or other indicia may also be provided on the wrist pad 18 or on other components of the wrist guard 10 to indicate the correct attachment position for either left or right-handed placement.

Figure 3:
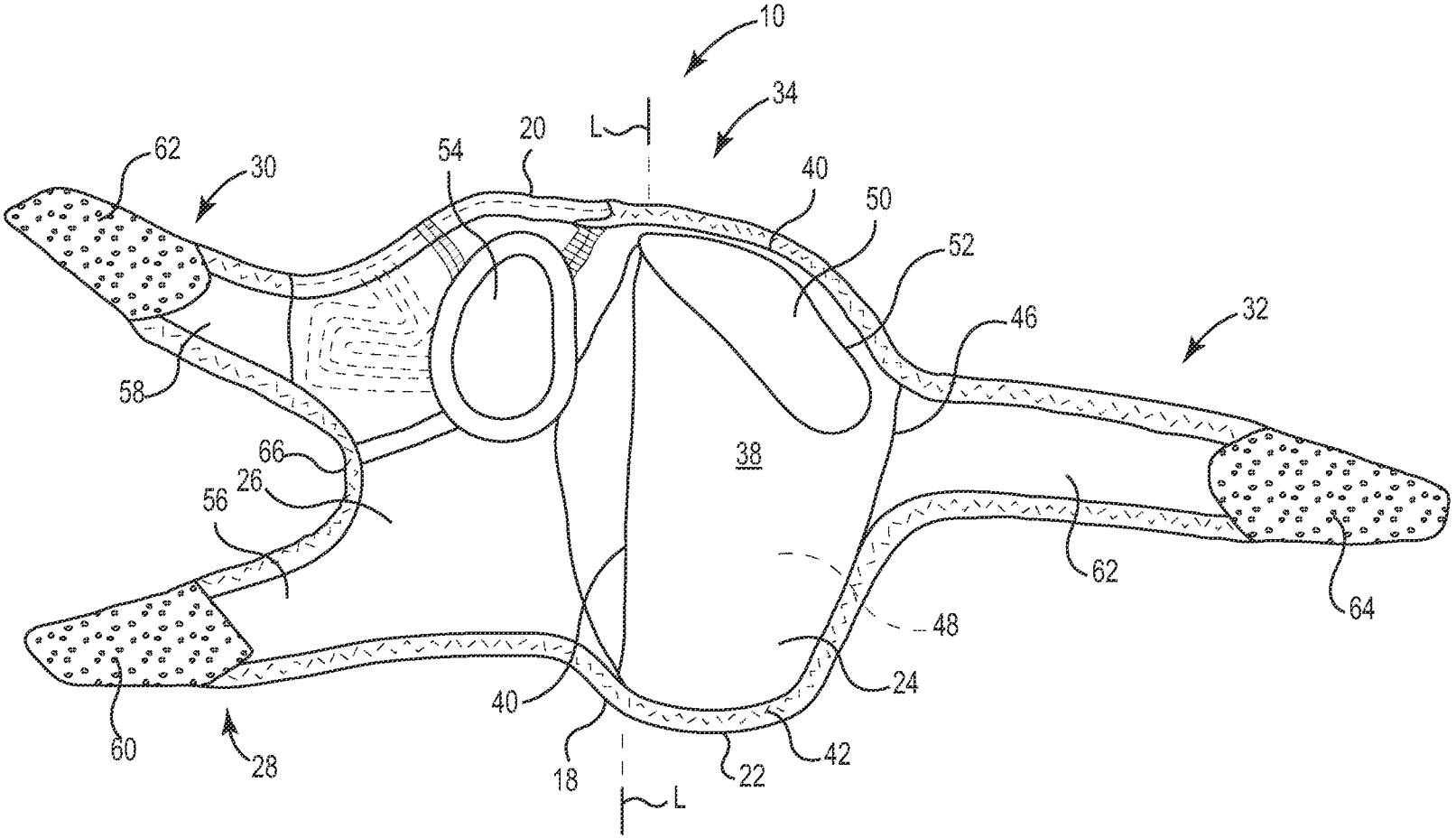
FIG. 3 is a plan view showing an interior side of the wrist guard of FIG. 1.

FIG. 3 is a plan view showing an interior side 34 of the wrist guard 10 of FIG. 1. As further shown in FIG. 3, the wrist pad 18 is divided into two generally rectangular-shaped sections about an imaginary longitudinal axis L that extends between the distal and proximal edges 20, 22, forming the dorsal and palmar sections 24, 26 of the wrist pad 18. In certain embodiments, the dorsal section 24 of the wrist pad 18 is formed by sewing two layers of pad material 38 together along a number of seams 40, 42, 46, thus forming a multi-layered structure. In use, this multi-layered structure provides additional padding to the posterior side of the user's wrist 12 for increased support and user comfort. The number of layers forming the dorsal section 24 can be greater or lesser, however, depending on the amount of support desired. In other embodiments, for example, the dorsal section 24 can include only a single layer of pad material 38, or can be constructed from a material 38 having multiple plies. Other configurations are also possible.

A first cushioning member 48 coupled to the dorsal section 24 provides additional padding to the posterior side of the user's wrist 12. In some embodiments, the cushioning member 48 comprises a gel or foam insert that is secured in place within an interior pocket of the wrist pad 18. In one such embodiment, for example, the cushioning member 48 can be secured in place within an interior pocket by sewing the member 48 in between the layers or plies of pad material 38 forming the dorsal section 24 of the wrist pad 18. In other embodiments, the cushioning member 48 can be made removable to permit the user to remove and/or replace the member 48, if desired. Other means for attaching the cushioning member 48 to the dorsal section 24 can also be employed.

In certain embodiments, and as further shown in FIG. 3, the dorsal section 24 of the wrist pad 18 can further include a second cushioning member 50 configured in size and shape to provide additional padding to the user's hand 14 at the location where the wrist joint connects to the fingers. In some embodiments, the cushioning member 50 comprises a silicon gel insert secured in place within an interior pocket of the wrist pad 18 positioned over the first cushioning member 48 at a location adjacent to the distal edge 20. In the embodiment shown in FIG. 3, for example, the cushioning member 50 is sewn into the dorsal section 24 of the wrist pad 18 via a seam 52, and is configured in size and shape to extend over only the portion of the wrist pad 18 located along the distal edge 20. In other embodiments, the cushioning member 50 can be removably coupled to the wrist pad 18 (e.g., via a pocket or sleeve) to permit the member 50 to be removed from the wrist pad 18 and/or replaced, if desired. In use, the cushioning member 50 provides additional padding at the location where the user's wrist 12 connects to the hand 14, including the location of the carpometacarpal, intercarpal, and radiocarpal joints.

The palmar section 26 of the wrist pad 18 can have either a single or multi-layered configuration, and includes an opening 54 located adjacent to the distal edge 20 adapted to receive the user's thumb. A number of retaining members 28, 30 extending laterally from the palmar section 26 of the wrist pad 18 can be utilized to fasten the palmar section 26 to the dorsal section 24 during attachment. Each of the retaining members 28, 30 can include a fabric strap 56, 58 having a free end 60, 62 with a VELCRO-type hook fastening material that connects to a VELCRO-type loop fastening material 68 coupled to the exterior of the dorsal section 24, as discussed further herein with respect to FIG. 4.

A third retaining member 32 extending laterally from the dorsal section 24 of the wrist pad 18 can be further utilized to attach the dorsal section 24 to the palmar section 26, and can similarly include a fabric strap 63 having an free end 64 with a VELCRO-type hook fastening material that connects to the loop fastening material 68. The length of the third retaining member 32 is generally longer than the other retaining members 28, 30 to permit the strap 32 to be wrapped around substantially the entire circumference of the wrist pad 18 during attachment. An indented portion 66 between the retaining members 28, 30 provides a guide for the wrapping the third retaining member 32 about the circumference of the wrist pad 18 during attachment.

Figure 4:
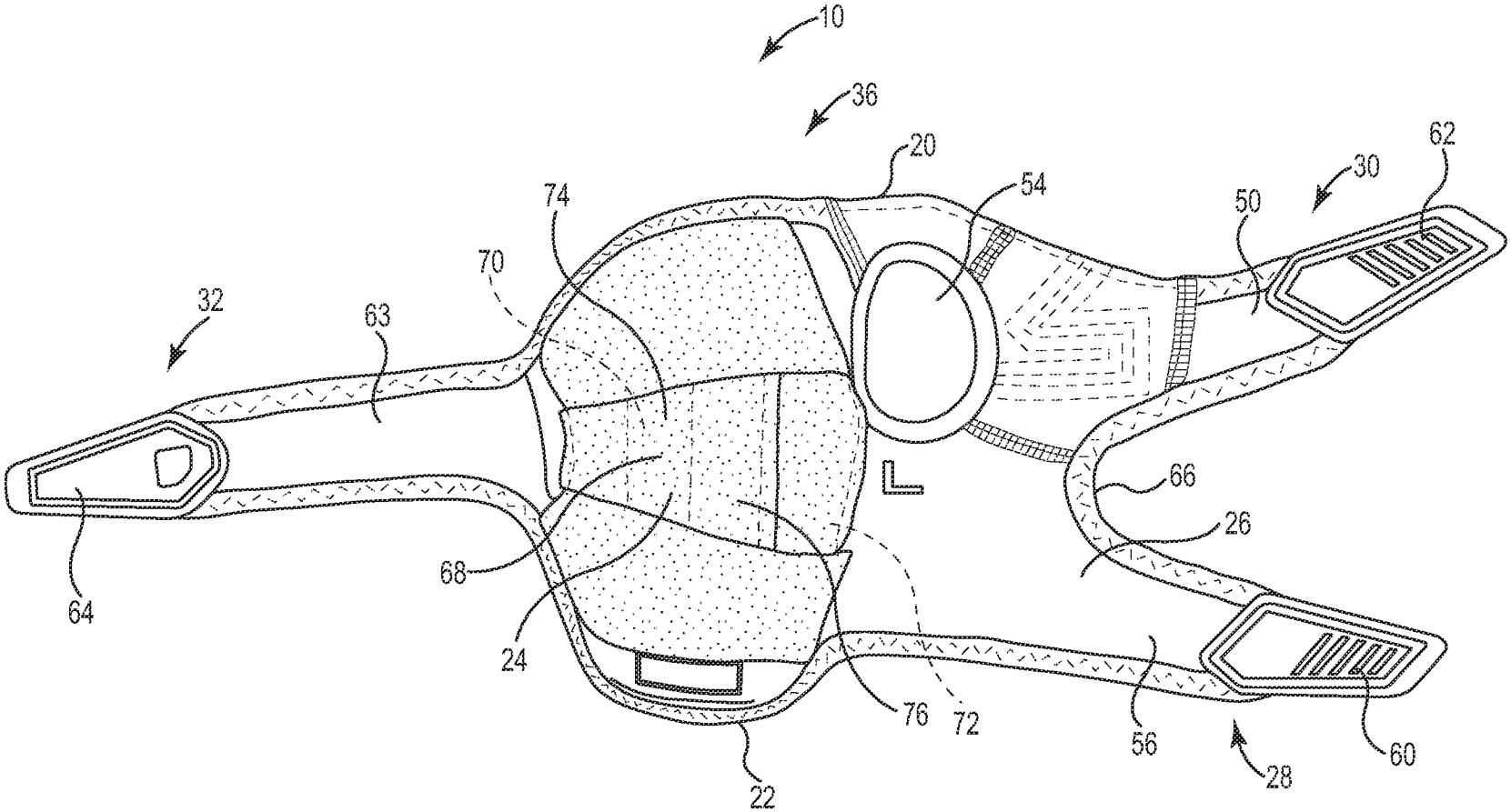
FIG. 4 is a plan view showing an exterior side of the wrist guard of FIG. 1.

FIG. 4 is a plan view showing an exterior side 36 of the wrist guard 10 of FIG. 1. As further shown in FIG. 4, the exterior surface of the dorsal section 24 includes a loop fastening material 68 such as unbroken loop fabric or pile fabric adapted to adhere to the hook fastening material on the free ends 60, 62, 64 of the retaining members 28, 30, 32. In some embodiments, and as shown in FIG. 4, the loop fastening material 68 covers the exterior surface of the dorsal section 24 and an adjoining portion of the palmar section 26, allowing the user to adjust both the tightness as well as relocate the positioning of the end portions 60, 62, 64 along the length of the wrist guard 10. Although hook and loop-type fasteners are depicted in FIGS. 3-4, other means for fastening the dorsal and palmar sections 24, 26 together can also be utilized. Examples of other suitable types of fasteners can include, but are not limited to, laces, strands, hooks, tabs, clasps, and/or latches.

To attach the wrist guard 10 to the user's wrist 12, the user may first insert their thumb through the opening 54 from a position facing the interior side 34 of the wrist guard 10, and then wrap the dorsal section 24 about the posterior portion of the user's wrist 12 and hand 14. Once secured in place, the hook fastening material on the free ends 60, 62, 64 of retaining members 28, 30, 32 can then be secured to the loop fastening material 68 on the exterior side 36 of the wrist guard 10.

Figure 5:
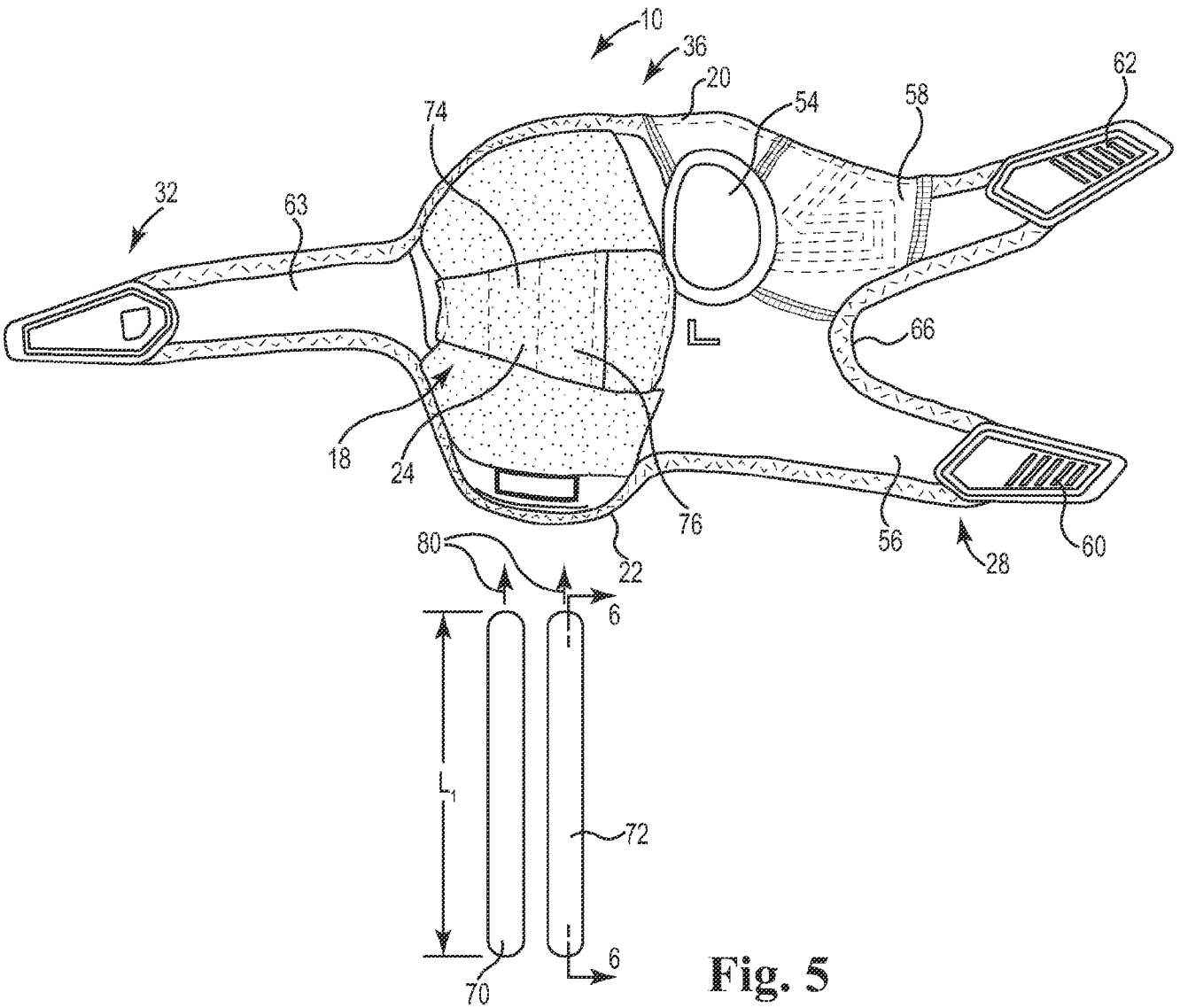
FIG. 5 is another plan view showing the exterior side of the wrist guard of FIG. 1 with the stiffener elements shown removed from within the pockets.

As shown in FIGS. 4 and 5, a number of stiffener elements 70, 72 each insertable within a corresponding pocket or sleeve 74, 76 within the dorsal section 24 are configured to provide additional stiffening support to the posterior side of the user's wrist 12 to protect against hyperextension of the wrist 12 during use. In some embodiments, and as can be further seen in FIG. 5, the stiffener elements 70, 72 may each comprise an elongate stay having a length that, when inserted into the pockets 74, 76, extend lengthwise along the general length of the wrist guard 10 between the distal and proximal edges 20, 22. The elongate stays may each comprise, for example, thin strips of plastic and/or metal that resist bending along their length. In certain embodiments, the stiffener elements 70, 72 may each have a length $L_1$ of between about 8 cm to 15 cm, and more specifically, about 13 cm to 14 cm, although other lengths are possible.

The stiffener elements 70, 72 are each insertable into a respective pocket 74, 76 that extends lengthwise along the general length of the wrist guard 10 beneath the loop fastening material 68 that receives the retaining members 28, 30, 32. A pocket flap 78 at the proximal edge 22 of the wrist pad 18 is configured to bend or displace, exposing a number of openings for inserting the stiffener elements 70, 72 into the pockets 74, 76 in the direction indicated generally by the arrows 80. Other means for securing the stiffener elements 70, 72 to the wrist guard 10 are also possible. In some embodiments, the stiffener elements 70, 72 can be formed as an integral part of the wrist guard 10 such as, for example, by permanently sewing the elements 70, 72 into the pockets 74, 76.

The number and configuration of the stiffener elements 70, 72 can be selected so as to impart a desired stiffness characteristic to the wrist guard 10. In some embodiments, for example, only one of two stiffener elements 70, 72 can be inserted into the wrist pad 18 to reduce the stiffness of the wrist guard 10, if desired. In other embodiments, multiple stiffener elements can be provided in a stacked configuration within each of the pockets 74, 76 to provide additional stiffness to the wrist guard 10, if desired. Other configurations employing multiple stiffening elements can also be used.

Figure 6:
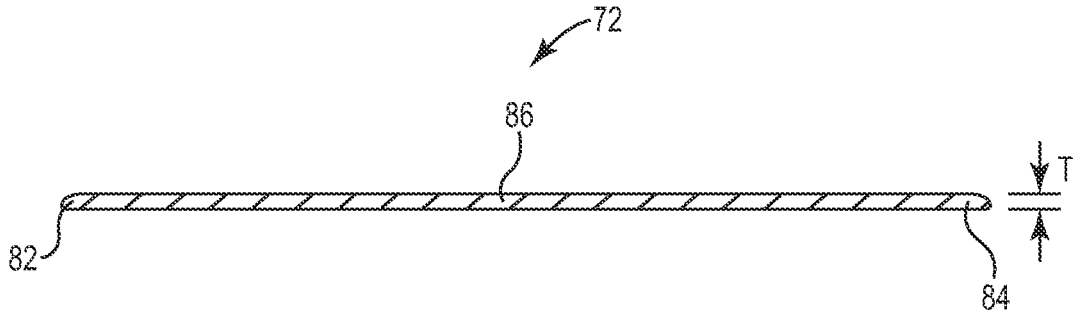
FIG. 6 is a longitudinal cross-sectional view showing one of the vertical stiffener elements along line 6-6 in FIG. 5.

FIG. 6 is a longitudinal cross-sectional view showing one of the stiffener elements 72 along line 6-6 in FIG. 5. As further shown in FIG. 6, each stiffener element 72 has a first end 82, a second end 84, and a middle portion 86. In certain embodiments, the stiffener element 72 may taper along its length such that the ends 82, 84 have a thickness T that is generally smaller than the thickness of the middle portion 86 thereof. By way of example and not limitation, the middle portion 86 of the stiffener element 72 may have a thickness in the range of about 1 mm to 3 mm whereas each of the ends 82, 84 may have a thickness in the range of about 0.5 mm to 1 mm. The reduction in thickness from the middle portion 86 to the ends 82, 84 can be continuous along the entire length of the stiffener element 72, or can reduce in thickness at one or more discrete locations along the length. In some embodiments, the stiffener element 72 may also have an arcuate shape which, in addition to the reduction in thickness, imparts a slight incurvation to the wrist guard 10 that conforms to the natural curve of the user's wrist 12 and hand 14. In one such embodiment, for example, the stiffener element 72 may be slightly curved so as to be lengthwise concave toward the user's palm and proximate the finger joints.

In use, the relatively small thickness of the stiffener element 72 at each of the ends 82, 84 increases the flexibility of the wrist guard 10 at or near the distal and proximal edges 20, 22. Conversely, the relatively large thickness at the middle portion 86 of the stiffener element 72 increases the stiffness at the location of the wrist guard 10 immediately adjacent to the user's wrist 12, which serves to reduce hyperextension of the wrist 12 during activity. This variable stiffness imparted by the reduction in thickness at or near the ends 82, 84 allows a full range of hand and finger motion while providing greater stiffness to the user's wrist 12.

Figure 7:
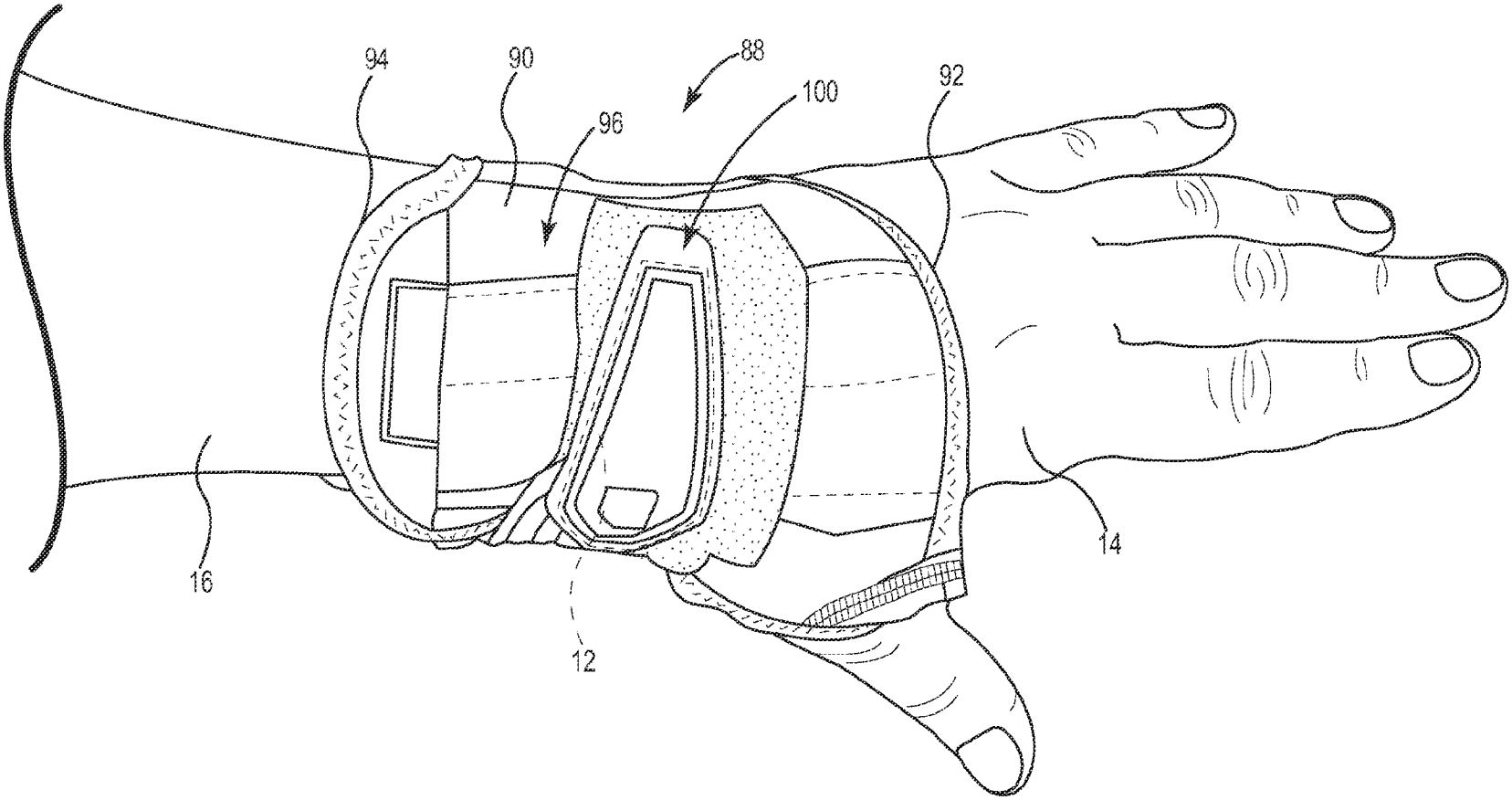
FIG. 7 is a perspective view showing a wrist guard in accordance with another illustrative embodiment attached to a user's hand.
Figure 8:
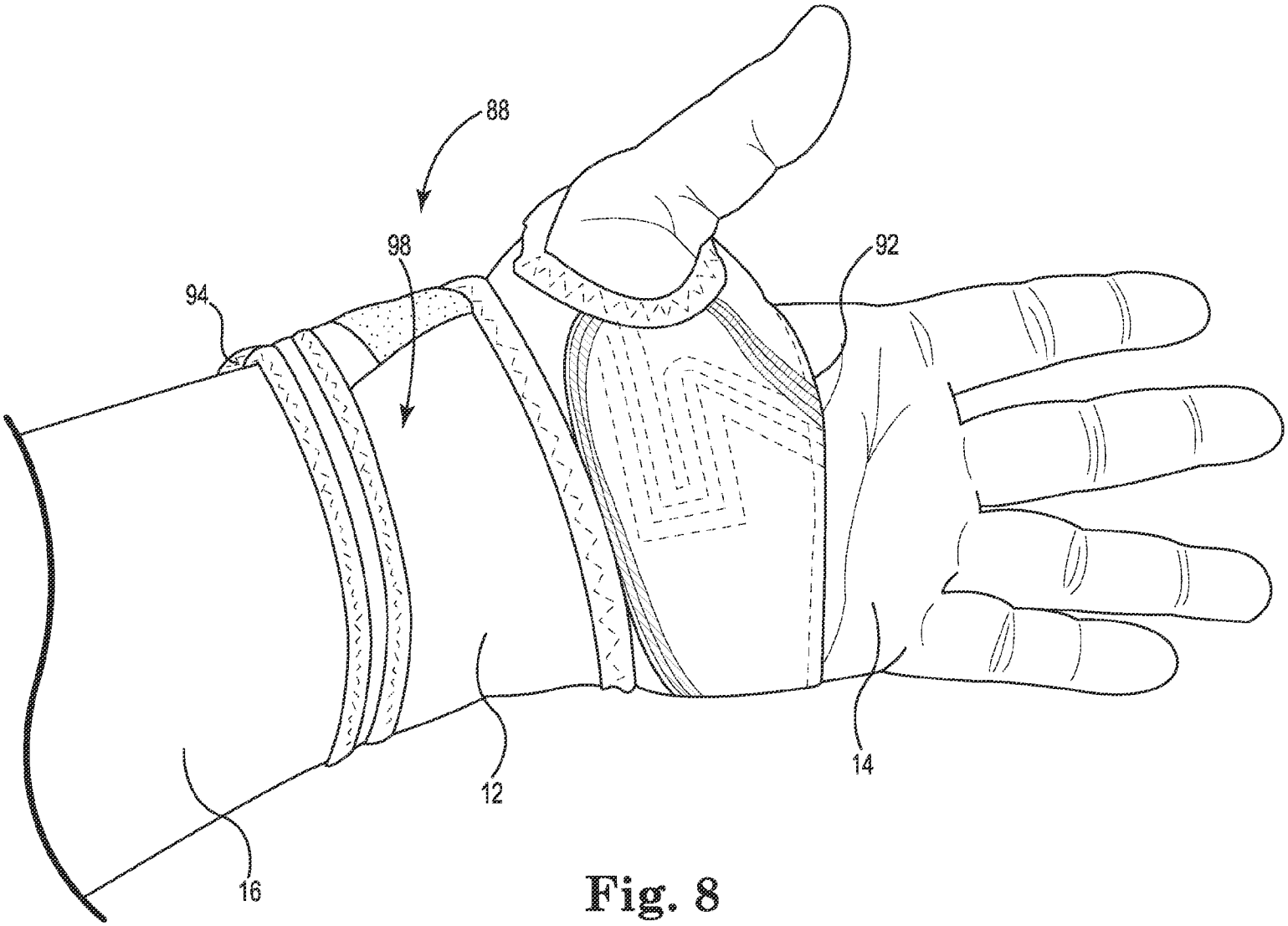
FIG. 8 is a perspective view showing the attachment of the wrist guard of FIG. 7 to the anterior side of the user's wrist.

FIGS. 7 and 8 are several perspective views showing a wrist guard 88 in accordance with another illustrative embodiment attached to a user's wrist 12. The wrist guard 88, illustratively a left-handed wrist guard, includes a generally rectangular-shaped wrist pad 90 similar to that discussed with respect to wrist guard 10, having a distal edge 92 that extends over at least a portion of the user's hand 14 and a proximal edge 94 located opposite the distal edge 92 that extends over at least a distal portion of the user's forearm 16 proximal to the wrist 12. As best shown in FIG. 7, a dorsal section 96 of the wrist guard 88 is configured to lay adjacent to the posterior side of the user's wrist 12. As further shown in FIG. 8, a palmar section 98 of the wrist guard 88 located opposite the dorsal section 96 is configured to lay adjacent to the anterior, palmar side of the user's wrist 12. A retaining member 100 on the wrist guard 88 can be used to secure the wrist guard 88 to the user's wrist 12 in a variety of different positions.

Figure 9:
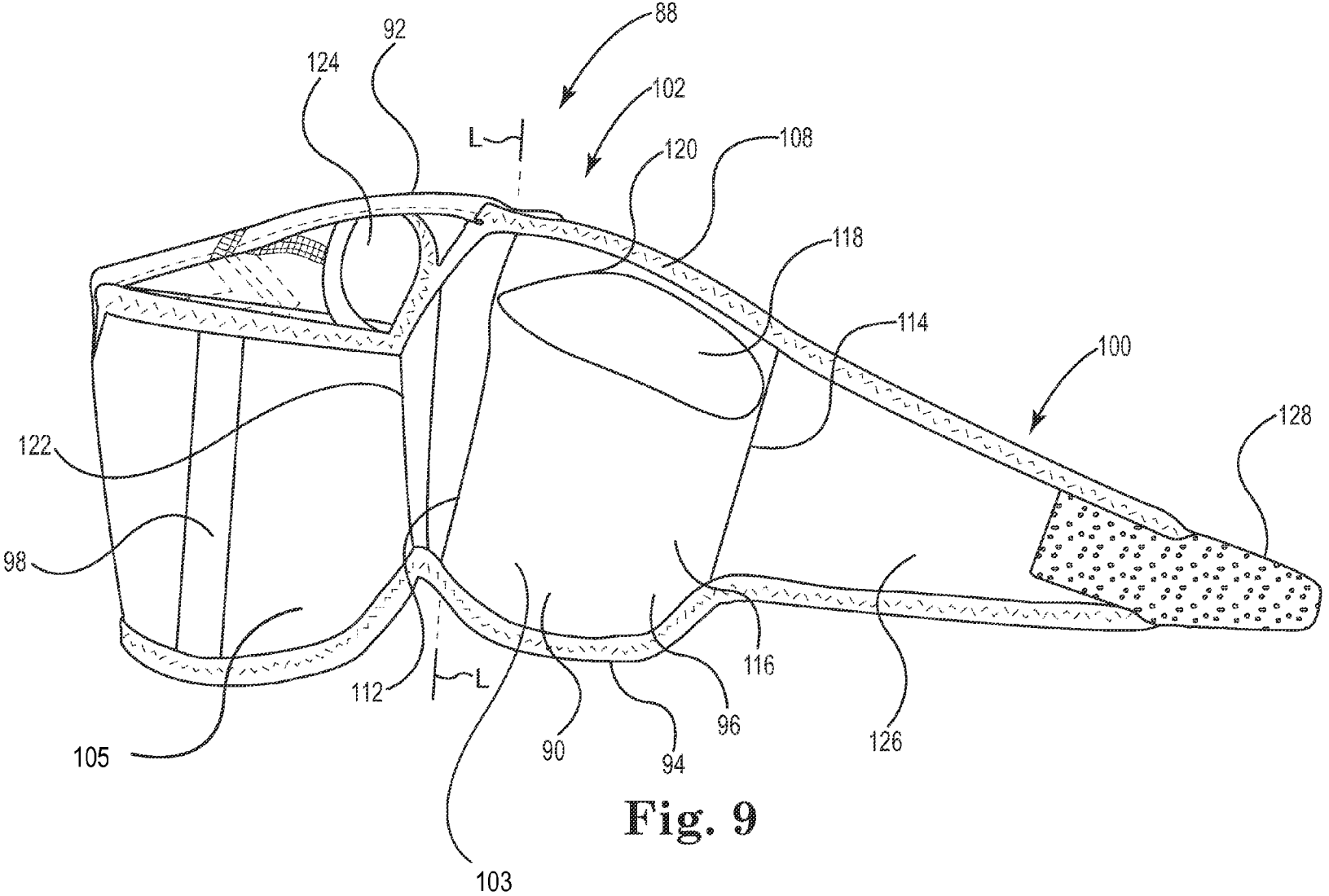
FIG. 9 is a plan view showing an interior side of the wrist guard of FIG. 7.

FIG. 9 is a plan view showing the interior side 102 of the wrist guard 88 of FIG. 8. As shown in FIG. 9, the pad 90 is divided into two generally rectangular-shaped sections about an imaginary longitudinal axis L that extends between the distal and proximal edges 92,94, forming the dorsal and palmar sections 96,98 of the wrist pad 90. The dorsal section 96 defines a first surface 103 and the palmar section 98 defines a second surface 105. When the wrist guard 88 is to be worn, a user places his or her hand into the palmar section 98 and folds, or wraps, the dorsal section 96 over the palmar section 98 to bring the first and second surfaces 103, 105 together. The retaining member 100 is wrapped around the folded dorsal and palmar sections 96, 98 and secured in the wrapped configuration, as described further below. In certain embodiments, the dorsal section 96 of the wrist pad 90 is formed by sewing two layers of pad material 106 together along a number of seams 108,112,114, thus forming a multi-layered structure. In use, this multi-layered structure provides additional padding to the posterior side of the user's wrist 12 for increased support and comfort. The number of layers forming the dorsal section 96 can be greater or lesser, however, depending on the amount of support desired.

A first cushioning member 116 coupled to the dorsal section 96 provides additional padding to the posterior side of the user's wrist 12. In some embodiments, the cushioning member 116 comprises a gel or foam insert that is secured in place within an interior pocket of the wrist pad 90. In one such embodiment, for example, the cushioning member 116 can be secured in place within an interior pocket by sewing the member 116 in between the layers or plies of pad material 106 forming the dorsal section 96 of the wrist pad 90. In other embodiments, the cushioning member 116 can be made removable to permit the user to remove and/or replace the member 116, if desired. Other means for attaching the cushioning member 116 to the dorsal section 96 can also be employed.

In certain embodiments, and as further shown in FIG. 9, the dorsal section 96 of the wrist pad 90 may further include a second cushioning member 118 configured in size and shape to provide additional padding to the user's hand 14 at the location where the wrist joint connects to the fingers. In some embodiments, the cushioning member 118 comprises a silicon gel insert secured in place within an interior pocket of the wrist pad 90 positioned over the first cushioning member 116 at a location adjacent to the distal edge 92. In the embodiment shown in FIG. 9, for example, the cushioning member 118 is sewn into the dorsal section 96 of the wrist pad 90 via a seam 120, and is configured in size and shape to extend over only the portion of the wrist pad 90 located along the distal edge 92. In other embodiments, the cushioning member 118 can be removably coupled to the wrist pad 90 (e.g., via a pocket or sleeve) to permit the member 118 to be removed from the wrist pad 90 and/or replaced, if desired. In use, the cushioning member 118 provides additional padding at the location where the user's wrist 12 connects to the hand 14, including the location of the carpometacarpal, intercarpal, and radiocarpal joints.

The palmar section 98 of the wrist pad 90 comprises one or more layers of pad material 106 folded upon itself and attached along a common seam line 122, forming a multi-layered structure that conforms to the user's wrist 12. An opening 124 located adjacent to the distal edge 92 of the wrist pad 90 is adapted to receive the user's thumb. A retaining member 100 extending laterally from the dorsal section 96 of the wrist pad 90 can be utilized to fasten the dorsal section 96 to the palmar section 98. In the embodiment shown, the retaining member 100 includes a fabric strap 126 having an free end 128 with a VELCRO-type hook fastening material that connects to a corresponding loop fastening material 130 coupled to the exterior side 104 of the wrist guard 88, as discussed further herein with respect to FIG. 10. The length of the fabric strap 126 is sufficiently long to permit the strap 126 to be wrapped around substantially the entire circumference of the wrist pad 90 during attachment.

Figure 10:
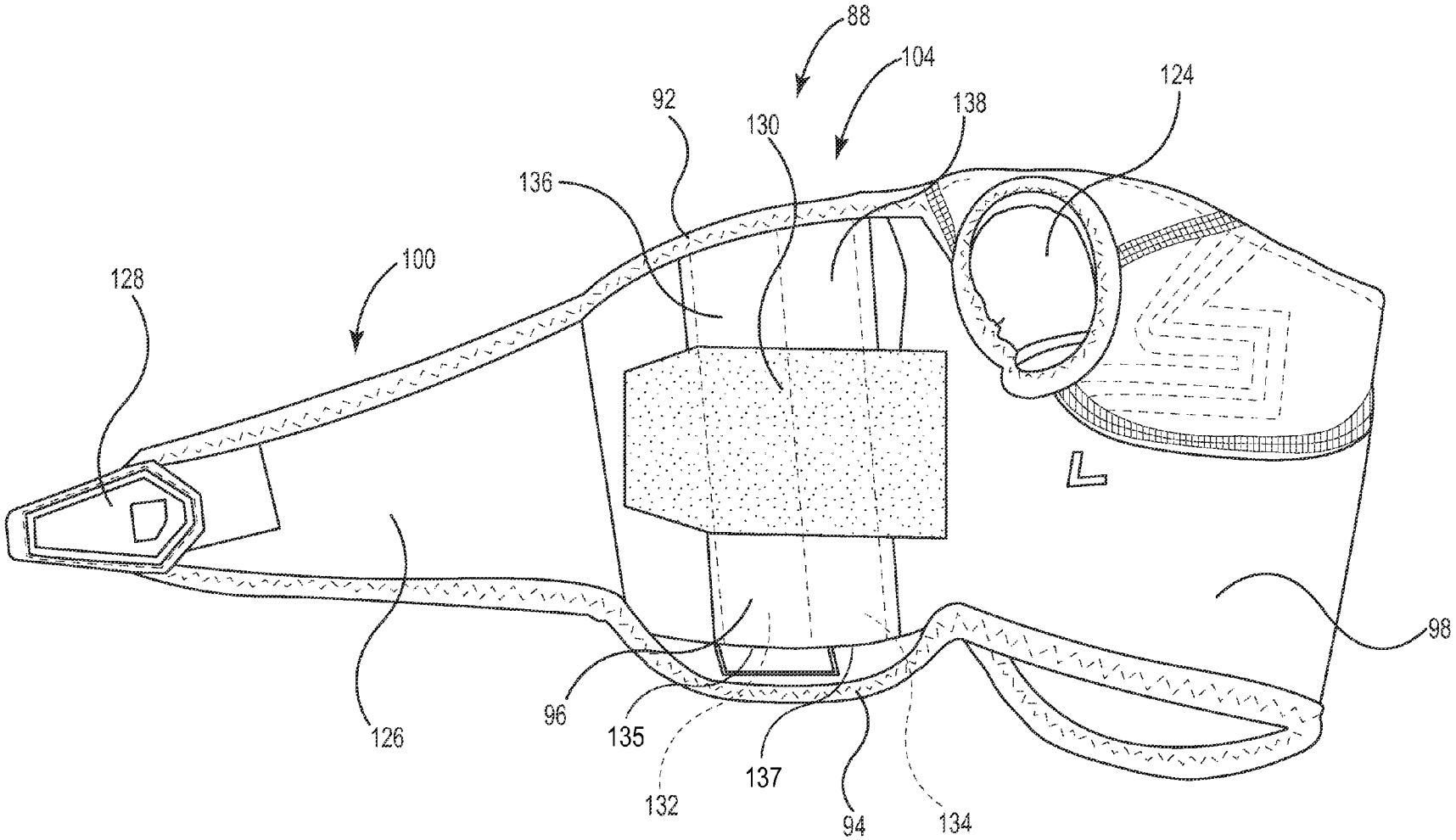
FIG. 10 is a plan view showing an exterior side of the wrist guard of FIG. 7.

FIG. 10 is a plan view showing an exterior side 104 of the wrist guard 88 of FIG. 7. As further shown in FIG. 10, the exterior surface of the dorsal section 96 includes a loop fastening material 130 such as unbroken loop fabric or pile fabric adapted to adhere to the free end 128 of the retaining member 100. Although a hook and loop-type fastener is depicted in FIGS. 9-10, other means for fastening the dorsal and palmar sections 96, 98 together can also be utilized.

Figure 11:
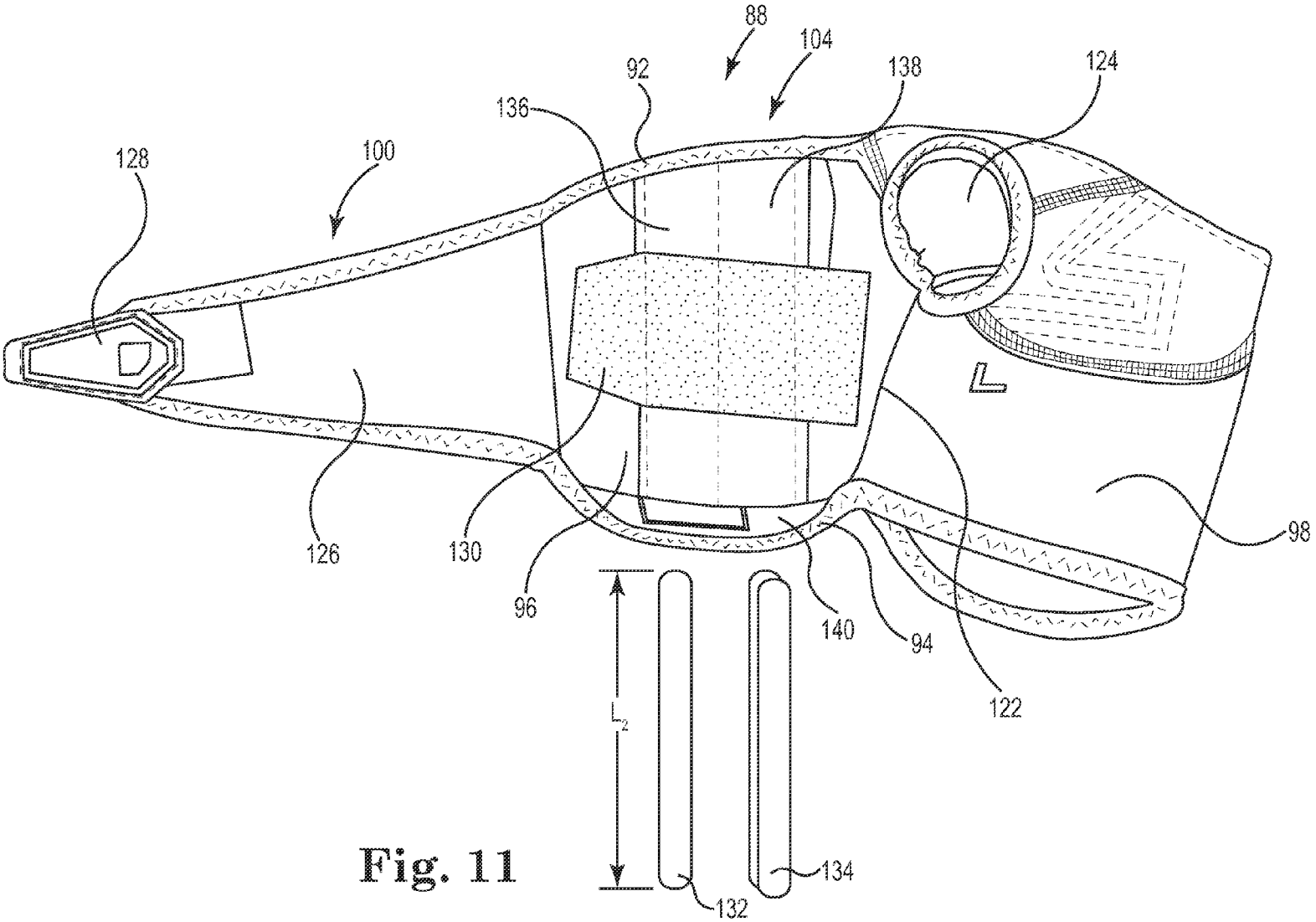
FIG. 11 is another plan view showing the exterior side of the wrist guard of FIG. 7 with the stiffener elements shown removed from within the pockets.

Perhaps as best shown in FIG. 11, a number of stiffener elements 132,134 each insertable through a corresponding opening 135,137 within a corresponding pocket 136,138 within the dorsal section 96 of the wrist pad 90 are configured to provide additional stiffening support to the posterior side of the user's wrist 12 to protect against hyperextension of the wrist 12 during use. In some embodiments, and as can be further seen in FIG. 11, the stiffener elements 132,134 may each comprise an elongate stay having a length, that when inserted into the pockets 136,138, extend lengthwise along the general length of the wrist guard 88 between the distal and proximal edges 92, 94. In the embodiment shown, the stiffener elements 132,134 may each have a length $L_2$ of between about 8 cm to 15 cm, and more specifically, about 10 cm to 12 cm, although other lengths are possible.

The stiffener elements 132, 134 are each insertable into a respective pocket 136, 138 that extends lengthwise along the general length of the wrist guard 88 beneath the loop fastening material 130 that receives the retaining member 100. A pocket flap 140 at the proximal edge 94 of the wrist pad 90 is configured to bend or displace, exposing a number of openings for insertion of the stiffener elements 132, 134 into the pockets 136, 138. Other means for securing the stiffener elements 132, 134 to the wrist guard 88 are also possible. In some embodiments, the stiffener elements 132, 134 can be formed as an integral part of the wrist guard 88 such as, for example, by permanently sewing the elements 132, 134 into the pockets 136, 138.

Figure 12:
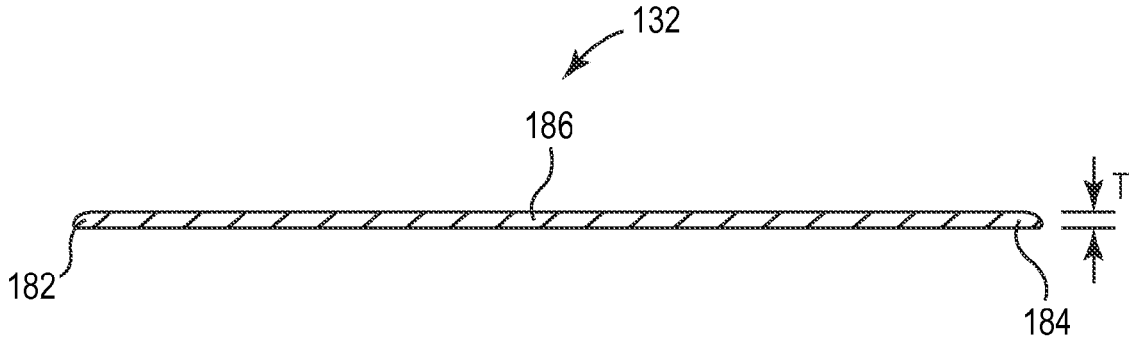
FIG. 12 is a longitudinal cross-sectional view showing one of the vertical stiffener elements in FIG. 11.

The number and configuration of the stiffener elements 132,134 can be selected so as to impart a desired stiffness characteristic to the wrist guard 88, similar to that described with respect to stiffener elements 70 and 72. For example, shown in FIG. 11, the configuration of the stiffener elements can be stacked, as shown by stiffener element 134. For another example, in some embodiments the stiffener elements 132,134 can comprise elongate stays having a thickness that varies along their length, either continuously or at one or more discrete locations along the length of the stay. An embodiment is illustrated in FIG. 12, which shows stiffener element 132 including ends 182,184 and a middle portion 186, similar to the ends 82,84 and the middle portion 86 of the stiffener elements 70,72. The stiffener elements 132,134 can each also have arcuate shape to impart a slight incurvation to the wrist guard 88.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to encompass all such alternatives, modifications, and variations as fall within the scope of the claims, together with all equivalents thereof.

What is claimed is:

1. A wrist guard, comprising:

a wrist pad attachable to a user's wrist, the wrist pad including a dorsal section configured for placement adjacent to the anterior side of a user's wrist, a palmar section configured for placement adjacent to the posterior side of the wrist, a distal edge, and a proximal edge, wherein the dorsal section includes a pocket;

a plurality of stiffener elements each extending lengthwise between the distal edge and proximal edge in a stacked configuration within the pocket of the dorsal section of the wrist pad, each stiffener element having a variable stiffness along a length of the stiffener element adapted to resist hyperextension of the wrist; and a fastener configured for securing the dorsal section of the wrist pad to the palmar section.

2. The wrist guard of claim 1, wherein the pocket includes an opening, the plurality of stiffener elements being insertable into and removable from the pocket through the opening in the pocket such that each of the stiffener elements in the plurality of stiffener elements is releasably coupled to the wrist pad.

3. The wrist guard of claim 1, wherein each of the stiffener elements in the plurality of stiffener elements is integrally formed with the wrist pad.

4. The wrist guard of claim 1, wherein each stiffener element includes an elongate stay having a first end portion, a second end portion, and a middle portion.

5. The wrist guard of claim 4, wherein a thickness of each stiffener element varies along the length of the stiffener element.

6. The wrist guard of claim 5, wherein the thickness of each stiffener element tapers along at least a portion of the stiffener element length.

7. The wrist guard of claim 5, wherein the thickness of each stiffener element changes at one or more locations along the stiffener element length.

8. The wrist guard of claim 4, wherein at least one of the plurality of stiffener elements has an arcuate shape.

9. The wrist guard of claim 1, wherein the length of at least one of the plurality of stiffener elements is between about 8 cm to 15 cm.

10. The wrist guard of claim 1, further including a cushioning member coupled to the dorsal section of the wrist pad.

11. The wrist guard of claim 1, further including:

a first cushioning member coupled to the dorsal section of the wrist pad; and a second cushioning member coupled to the dorsal section of the wrist pad.

12. The wrist guard of claim 11, wherein the second cushioning member is positioned over the first cushioning member and is located adjacent to the distal edge of the wrist pad.

13. The wrist guard of claim 1, wherein the fastener includes a hook and loop-type fastener.

* * * * *